US005799639A

United States Patent [19]

Isobe et al.

[11] Patent Number: 5,799,639

[45] Date of Patent: Sep. 1, 1998

[54] EVAPORATIVE FUEL-PROCESSING SYSTEM FOR INTERNAL COMBUSTION ENGINES

[75] Inventors: Takashi Isobe; Fumio Hara, both of Wako, Japan

[73] Assignee: Honda Giken Kogyo Kabushiki Kaisha, Tokyo, Japan

[21] Appl. No.: 859,705

[22] Filed: May 21, 1997

[30] Foreign Application Priority Data

May 22, 1996 [JP] Japan ..... 8-149728

[51] Int. Cl.[6] ..... F02M 37/04

[52] U.S. Cl. ..... 123/520; 123/198 D

[58] Field of Search ..... 123/520, 521, 123/518, 519, 516, 198 D

[56] References Cited

U.S. PATENT DOCUMENTS

| | | | |
|---|---|---|---|
| 5,299,545 | 4/1994 | Kuroda | 123/198 D |
| 5,448,980 | 9/1995 | Kawamura | 123/198 D |
| 5,450,834 | 9/1995 | Yamanaka | 123/198 D |
| 5,479,905 | 1/1996 | Ito | 123/198 D |
| 5,601,065 | 2/1997 | Tamura | 123/198 D |

FOREIGN PATENT DOCUMENTS

| | | |
|---|---|---|
| 6-26408 | 2/1994 | Japan . |
| 6-81728 | 3/1994 | Japan . |

*Primary Examiner*—Carl S. Miller

*Attorney, Agent, or Firm*—Nikaido, Marmelstein, Murray & Oram LLP

[57] ABSTRACT

An evaporative fuel-processing system for an internal combustion engine includes a canister for adsorbing evaporative fuel generated in the fuel tank, a charging passage, a pressure-regulating valve for regulating pressure within the fuel tank to a predetermined value, a bypass passage, a bypass valve for opening and closing the bypass passage, a purging passage, an open-to-atmosphere passage for relieving the interior of the canister to the atmosphere, a tank system formed by a part of the charging passage on one side of the bypass valve closer to the fuel tank, inclusive of the fuel tank, and a pressure sensor for detecting pressure within the tank system. An ECU opens and closes the bypass valve at cold starting of the engine, and compares the difference between output values from the pressure sensor obtained before and after opening of the bypass valve with a predetermined value. Presence of leakage from the tank system is checked based on the result of the comparison.

10 Claims, 6 Drawing Sheets

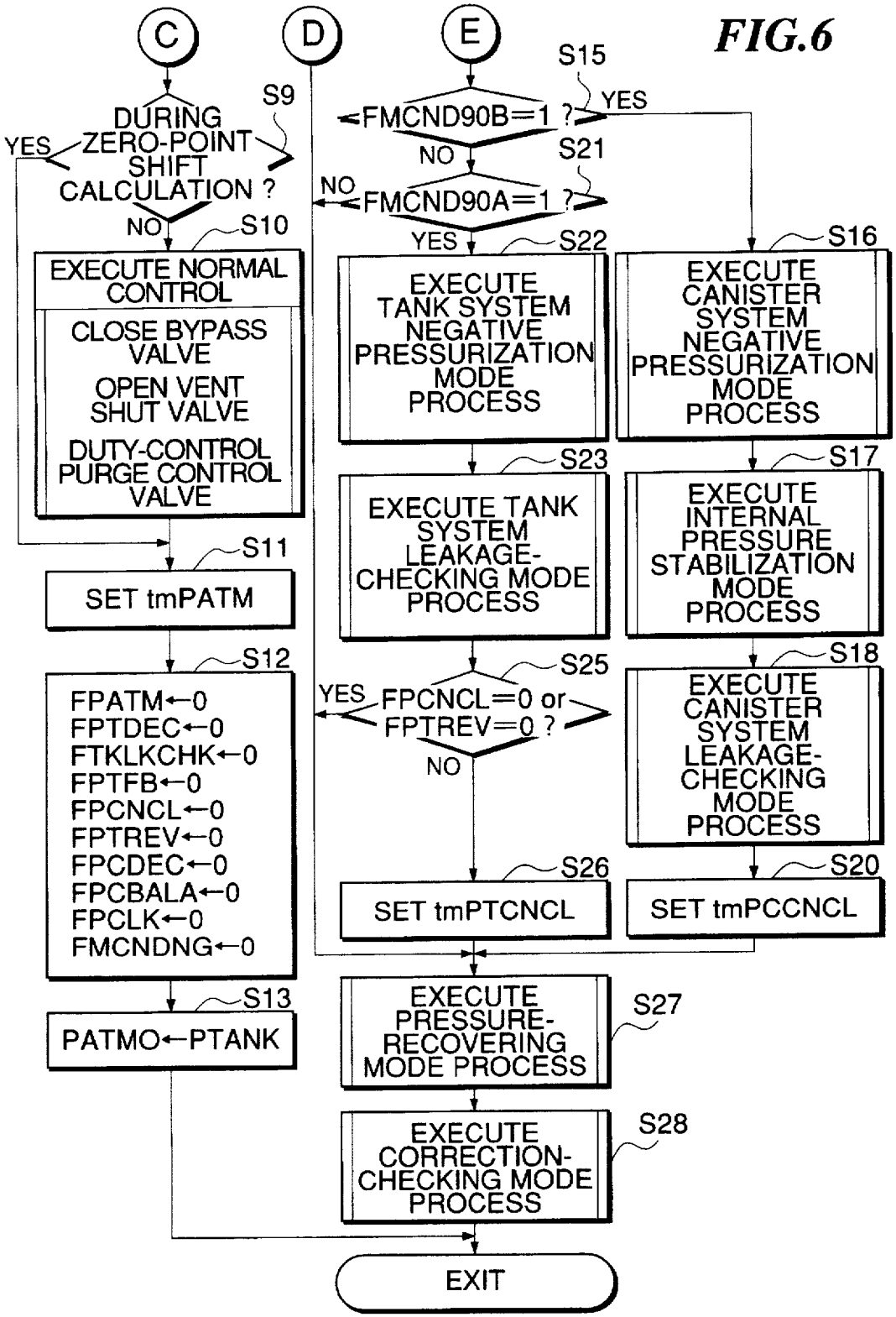
FIG.6
C
D
E
S9
DURING ZERO-POINT SHIFT CALCULATION ?
YES
NO
S10
EXECUTE NORMAL CONTROL
CLOSE BYPASS VALVE
OPEN VENT SHUT VALVE
DUTY-CONTROL PURGE CONTROL VALVE
S11
SET tmPATM
S12
FPATM←0
FPTDEC←0
FTKLKCHK←0
FPTFB←0
FPCNCL←0
FPTREV←0
FPCDEC←0
FPCBALA←0
FPCLK←0
FMCNDNG←0
S13
PATMO←PTANK
S15
FMCND90B=1 ?
YES
NO
S21
FMCND90A=1 ?
NO
YES
S22
EXECUTE TANK SYSTEM NEGATIVE PRESSURIZATION MODE PROCESS
S23
EXECUTE TANK SYSTEM LEAKAGE-CHECKING MODE PROCESS
S25
FPCNCL=0 or FPTREV=0 ?
YES
NO
S26
SET tmPTCNCL
S16
EXECUTE CANISTER SYSTEM NEGATIVE PRESSURIZATION MODE PROCESS
S17
EXECUTE INTERNAL PRESSURE STABILIZATION MODE PROCESS
S18
EXECUTE CANISTER SYSTEM LEAKAGE-CHECKING MODE PROCESS
S20
SET tmPCCNCL
S27
EXECUTE PRESSURE-RECOVERING MODE PROCESS
S28
EXECUTE CORRECTION-CHECKING MODE PROCESS
EXIT

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, which purges evaporative fuel generated in the fuel tank into the intake system of the engine, and more particularly to an evaporative fuel-processing system of this kind, which has a function of determining whether or not there is leakage from an evaporative emission control system of the engine which extends from the fuel tank to the intake system.

2. Prior Art

There is widely known an evaporative fuel-processing system for internal combustion engines, which is provided with an evaporative emission control system including a fuel tank, a canister for adsorbing evaporative fuel generated in the fuel tank, a charging passage connecting between the canister and the fuel tank, and a purging passage connecting between the canister and the intake system of the engine. To determine the presence of leakage from the evaporative emission control system of the known evaporative fuel-processing system, especially from a tank system which is a part of the evaporative emission control system including the fuel tank and its related parts, it is widely employed to negatively pressurize the interior of the tank system and hold the same in the negatively pressurized state, followed by checking the presence of leakage from the tank system by detecting the pressure within the same. This determination method, however, adversely affects the air-fuel ratio of an air-fuel mixture supplied to the engine because the tank system is held in the negatively pressurized state.

To overcome the above inconvenience, a leakage (abnormality)-determining method is conventionally known, for example, from Japanese Laid-Open Patent Publication (Kokai) No. 6-26408, which detects a change in pressure within the charging passage connecting between the canister and the fuel tank over a predetermined time period from the start of the engine, and determines that the tank system suffers from leakage (i.e. it is abnormal) if the detected change in pressure falls within a predetermined range. This method, however, cannot always perform accurate leakage detection depending upon generation of evaporative fuel in the fuel tank.

To prevent erroneous detection of leakage from the tank system due to generation of evaporative fuel, a method has been proposed, for example, by Japanese Laid-Open Patent Publication (Kokai) No. 6-81728, which determines that the tank system suffers from leakage or is abnormal if the pressure within the charging passage does not become negative even after the lapse of a predetermined time period after the start of the engine in a cold condition (hereinafter referred to as "cold starting"). This method is based on the fact that if there is no leakage from the charging passage, the pressure within the charging passage should once become negative due to consumption of fuel by the engine after cold starting thereof.

According to this proposed method, however, if the pressure within the charging passage (almost equal to the pressure within the fuel tank) assumes a positive value immediately before the leakage checking of the tank system is carried out, the pressure within the fuel tank cannot become always negative even when there is no leakage from the tank system including the charging passage after cold starting of the engine. In such an event, an erroneous determination can be made that there is leakage from the tank system (the tank system is abnormal), though there is actually no leakage from the tank system (the tank system is normal).

Further, according to the proposed method, a pressure sensor is used to detect the pressure within the charging passage and an output from the sensor is employed as it is for the abnormality determination. To positively prevent an erroneous determination, therefore, detection errors (approximately ±4.5 mmHg) in the output from the pressure sensor due to deterioration or variations thereof must be taken into account. To this end, a threshold value for determination of normality of the tank system has to be set to a sufficiently negative value (e.g. −5 mmHg). As a result, however, if the pressure within the tank system assumes a slightly negative value (e.g. −2 to −4 mmHg), the tank system cannot be determined to be normal, thus making it difficult to positively determine abnormality of the tank system.

SUMMARY OF THE INVENTION

It is the object of the invention to provide an evaporative fuel-processing system for internal combustion engines, which is capable of performing accurate determination as to abnormality of the tank system irrespective of whether the pressure within the tank system is positive or negative and without being affected by detection errors in the output from the pressure sensor.

To attain the object, the present invention provides an evaporative fuel-processing system for an internal combustion engine having a fuel tank, and an intake system, including a canister for adsorbing evaporative fuel generated in the fuel tank, a charging passage extending between the canister and the fuel tank, a pressure-regulating valve arranged across the charging passage, for regulating pressure within the fuel tank to a predetermined value, a bypass passage bypassing the pressure-regulating valve, a bypass valve arranged across the bypass passage, for opening and closing the bypass passage, a purging passage extending between the canister and the intake system, an open-to-atmosphere passage for relieving an interior of the canister to atmosphere, a tank system formed by a part of the charging passage on one side of the bypass valve closer to the fuel tank, inclusive of the fuel tank, and a pressure sensor for detecting pressure within the tank system. The evaporative fuel-processing system is characterized by an improvement comprising:

- valve-opening means for opening the bypass valve at cold starting of the engine;
- comparing means for comparing a difference between an output value from the pressure sensor obtained before opening of the bypass valve and an output value from the pressure sensor obtained after the opening of the bypass valve with a predetermined value; and
- leakage-checking means for checking presence of leakage from the tank system, based on a result of the comparison by the comparing means.

Preferably, the leakage-checking means includes normality-determining means for determining that the tank system is normal when the difference is equal to or larger than the predetermined value.

Also preferably, the leakage-checking means includes abnormality determining means for determining that the tank system is abnormal when the difference is smaller than the predetermined value.

More preferably, the evaporative fuel-processing system includes temperature-detecting means for detecting temperature of intake air supplied to the engine and temperature of coolant of the engine, and cold starting-determining means for determining that the engine has been started in a cold condition if the engine has been started when the temperature of the intake air and the temperature of the coolant detected by the temperature-detecting means both fall within a predetermined range and at the same time a difference between the temperature of the intake air and the temperature of the coolant is below a predetermined value.

Preferably, the evaporative fuel-processing system includes enabling means operable when an amount of change in an output value from the pressure sensor over a predetermined time period from the cold starting of the engine is equal to or smaller than a predetermined value, for enabling the valve-opening means to open the bypass valve and the normality-determining means to execute the determination as to normality of the tank system.

Preferably, the evaporative fuel-processing system includes enabling means operable when an amount of change in an output value from the pressure sensor over a predetermined time period from the cold starting of the engine is equal to or smaller than a predetermined value, for enabling the valve-opening means to open the bypass valve and the abnormality-determining means to execute the determination as to abnormality of the tank system.

More preferably, the evaporative fuel-processing system includes second normality-determining means for determining that the tank system is normal when the amount of change in the output value from the pressure sensor over the predetermined time period from the cold starting of the engine is larger than the predetermined value.

Advantageously, the valve-opening means opens the bypass valve over a predetermined time period within which an output value from the pressure sensor becomes equal to atmospheric pressure after the bypass valve is opened by the valve-opening means.

The above and other objects, features, and advantages of the invention will be more apparent from the following detailed description taken in conjunction with the accompanying drawings.

BRIEF DESCRIPTION OF THE DRAWINGS

FIG. 6 is a continued part of the flowchart of FIG. 5.

DETAILED DESCRIPTION

The invention will now be described in detail with reference to the drawings showing an embodiment thereof.

Figure 1:
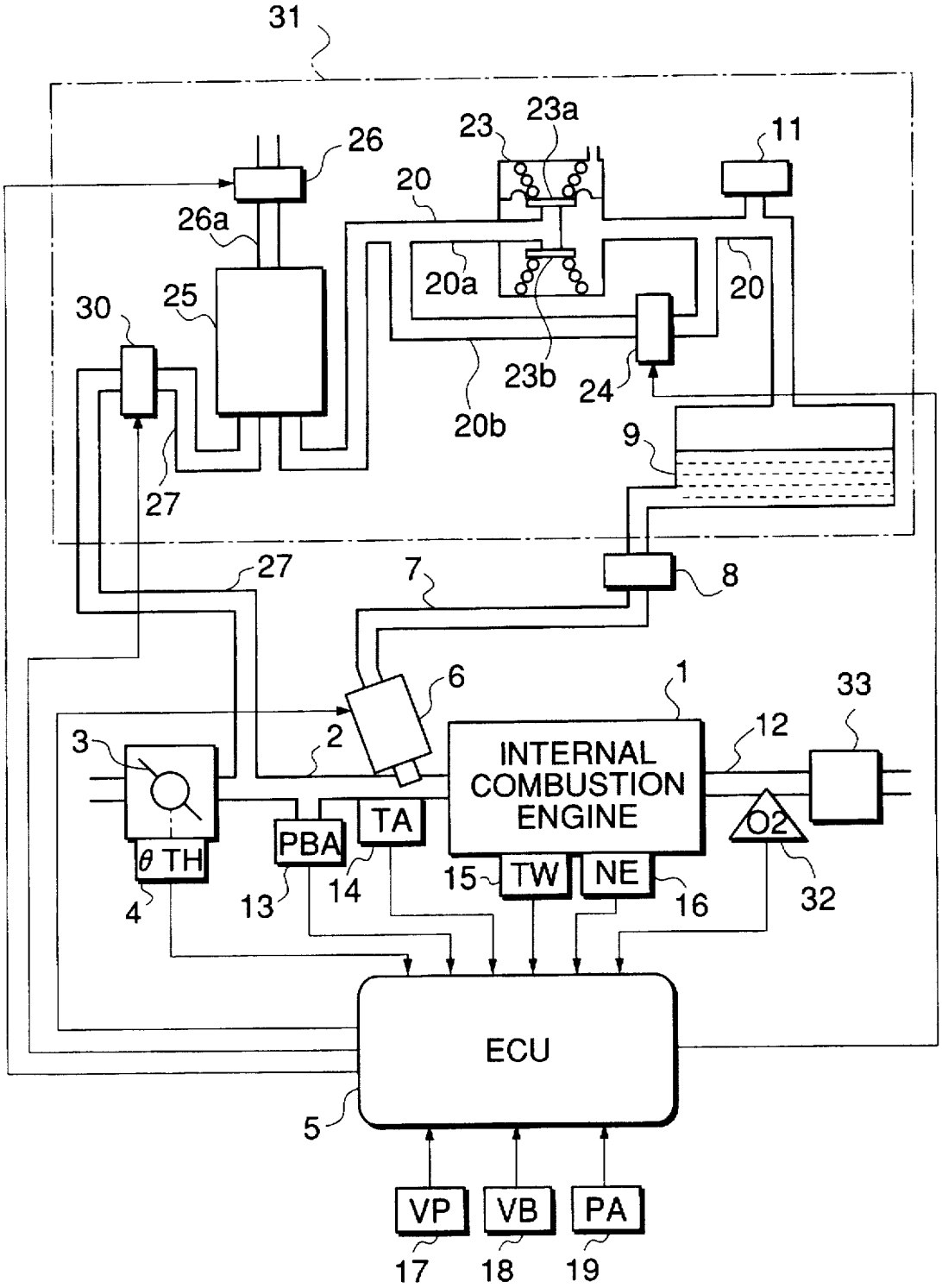
FIG. 1 is a block diagram schematically showing the whole arrangement of an internal combustion engine and an evaporative fuel-processing system therefor, according to an embodiment of the invention.

Referring first to FIG. 1, there is illustrated the whole arrangement of an internal combustion engine and an evaporative fuel-processing system therefor, according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2, in which is arranged a throttle valve 3. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective intake valves, not shown. The fuel injection valves 6 are connected to a fuel tank 9 via a fuel supply pipe 7 and a fuel pump 8 arranged thereacross. The fuel injection valves 6 are electrically connected to the ECU 5 to have their valve opening periods controlled by signals therefrom.

An intake pipe absolute pressure (PBA) sensor 13 and an intake air temperature (TA) sensor 14 are inserted into the intake pipe 2 at locations downstream of the throttle valve 3. The PBA sensor 13 detects absolute pressure PBA within the intake pipe 2, and the TA sensor 14 detects intake air temperature TA. These sensors supply electric signals indicative of the respective sensed parameters to the ECU 5.

An engine coolant temperature (TW) sensor 15 formed of a thermistor or the like is inserted in a coolant passage formed in the cylinder block, which is filled with an engine coolant, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The NE sensor 16 generates a signal pulse as a TDC signal pulse at each of predetermined crank angles whenever the crankshaft rotates through 180 degrees, the signal pulse being supplied to the ECU 5.

Arranged in an exhaust pipe 12 is an O2 sensor 32 as an exhaust gas component concentration sensor for detecting the concentration VO2 of oxygen present in exhaust gases from the engine, and generating a signal indicative of the sensed oxygen concentration VO2 to the ECU 5. Further, a three-way catalyst 33 is arranged in the exhaust pipe 12 at a location downstream of the O2 sensor 32, for purifying exhaust gases emitted from the engine 1.

Further electrically connected to the ECU 5 are a vehicle speed sensor 17 for detecting the traveling speed VP of an automotive vehicle in which the engine 1 is installed, a battery voltage sensor 18 for detecting output voltage VB from a battery, not shown, of the engine, and an atmospheric pressure sensor 19 for detecting atmospheric pressure PA, of which respective output signals indicative of the sensed parameter values are supplied to the ECU 5.

Next, an evaporative emission control system (hereinafter referred to as "the emission control system") 31 will be described, which is comprised of the fuel tank 9, a charging passage 20, a canister 25, a purging passage 27, etc.

The fuel tank 9 is connected to the canister 25 via the charging passage 20 which has a bifurcated portion consisting of first and second divided passages **20*a* and 20*b* arranged in an engine compartment, not shown. A pressure sensor 11 is inserted in the charging passage 20 at a location intermediate between the divided passages 20***a* and 20*b* and the fuel tank 9, for detecting pressure PTANK within the charging passage 20. The pressure PTANK is almost equal to pressure within the fuel tank 9, and will therefore be referred to as "the tank internal pressure" hereinafter.

The first divided passage 20*a* is provided with a two-way valve 23 as a pressure-regulating value arranged thereacross. The two-way valve 23 is a mechanical valve formed of a positive pressure valve 23*a* which opens when the tank internal pressure PTANK is higher than the atmospheric pressure by approximately 20 mmHg or more, and a negative pressure valve 23*b* which opens when the tank internal pressure PTANK is lower than pressure within the charging passage 20 on one side of the two-way valve 23 closer to the canister 25 by a predetermined amount or more.

The second divided passage 20*b* is provided with a bypass valve 24 arranged thereacross, which is a normally-closed electromagnetic valve, and is selectively opened and closed during execution of abnormality determination, described hereinafter, by a signal from the ECU 5.

The canister 25 contains activated carbon for adsorbing evaporative fuel, and has an air inlet port, not shown, communicating with the atmosphere via a passage 26*a*. Arranged across the passage 26*a* is a vent shut valve 26 which is a normally-open electromagnetic valve and is temporarily closed during execution of the abnormality determination, by a signal from the ECU 5.

The canister 25 is connected via the purging passage 27 to the intake pipe 2 at a location downstream of the throttle valve 3. The purging passage 27 has a purge control valve 30 arranged thereacross. The purge control valve 30 is an electromagnetic valve which is adapted to continuously change the flow rate of a mixture of evaporative fuel and air as the on/off duty ratio of a control signal from the ECU 5 supplied thereto is changed.

The emission control system 31 constructed as above can be divided into a tank system and a canister system. The tank system is defined as a part of the emission control system 31 located on one side of the bypass valve 24 closer to the fuel tank 9 inclusive of the same, and the canister system the other part of the emission control system 31, i.e. a part located on the other side of the bypass valve 24 closer to the canister 25 inclusive of the same and the purging passage 27.

The evaporative fuel-processing system is comprised of the evaporative emission control system 31 and the ECU 5.

The ECU 5 is comprised of an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), a memory circuit storing operational programs executed by the CPU and for storing results of calculations therefrom, etc., and an output circuit which outputs driving signals to the fuel injection valves 6, bypass valve 24, and purge control valve 30.

The CPU of the ECU 5 operates in response to various engine operating parameter signals from the above-mentioned various sensors to determine operating conditions in which the engine 1 is operating, such as an air-fuel ratio feedback control region where the air-fuel ratio is controlled in response to the oxygen concentration VO2 in exhaust gases from the engine 1 detected by the O2 sensor 32, and air-fuel ratio open-loop control regions, and calculates, based upon the determined engine operating conditions, a fuel injection period Tout over which each fuel injection valve 6 is to be opened, in synchronism with generation of TDC signal pulses, by the use of the following equation (1):

$$Tout=Ti\times K1\times KO2+K2 \quad (1)$$

where Ti represents a basic value of the fuel injection period Tout of the fuel injection valve 6, which is read from a Ti map determined according to the engine rotational speed NE and the intake pipe absolute pressure PBA.

KO2 represents an air-fuel ratio correction coefficient which is determined based on the oxygen concentration VO2 in exhaust gases detected by the O2 sensor 32 when the engine 1 is operating in the air-fuel ratio feedback control region, while it is set to predetermined values corresponding to the respective operating regions of the engine when the engine 1 is in the air-fuel ratio open-loop control regions.

K1 and K2 represent other correction coefficients and correction variables, respectively, which are set according to engine operating parameters to such values as optimize engine operating characteristics, such as fuel consumption and engine accelerability.

Figure 2:
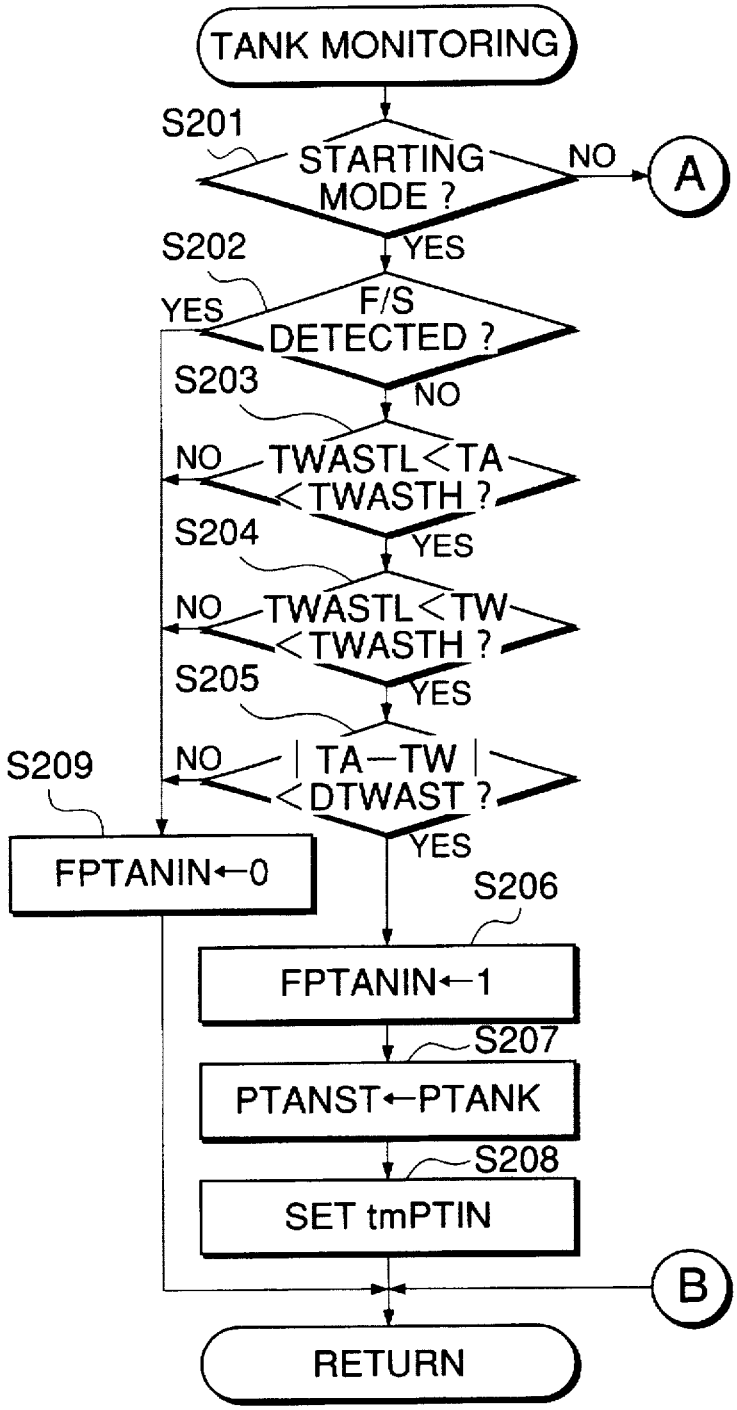
FIG. 2 is a flowchart showing a program for carrying out tank monitoring immediately after cold starting of the engine.
Figure 3:
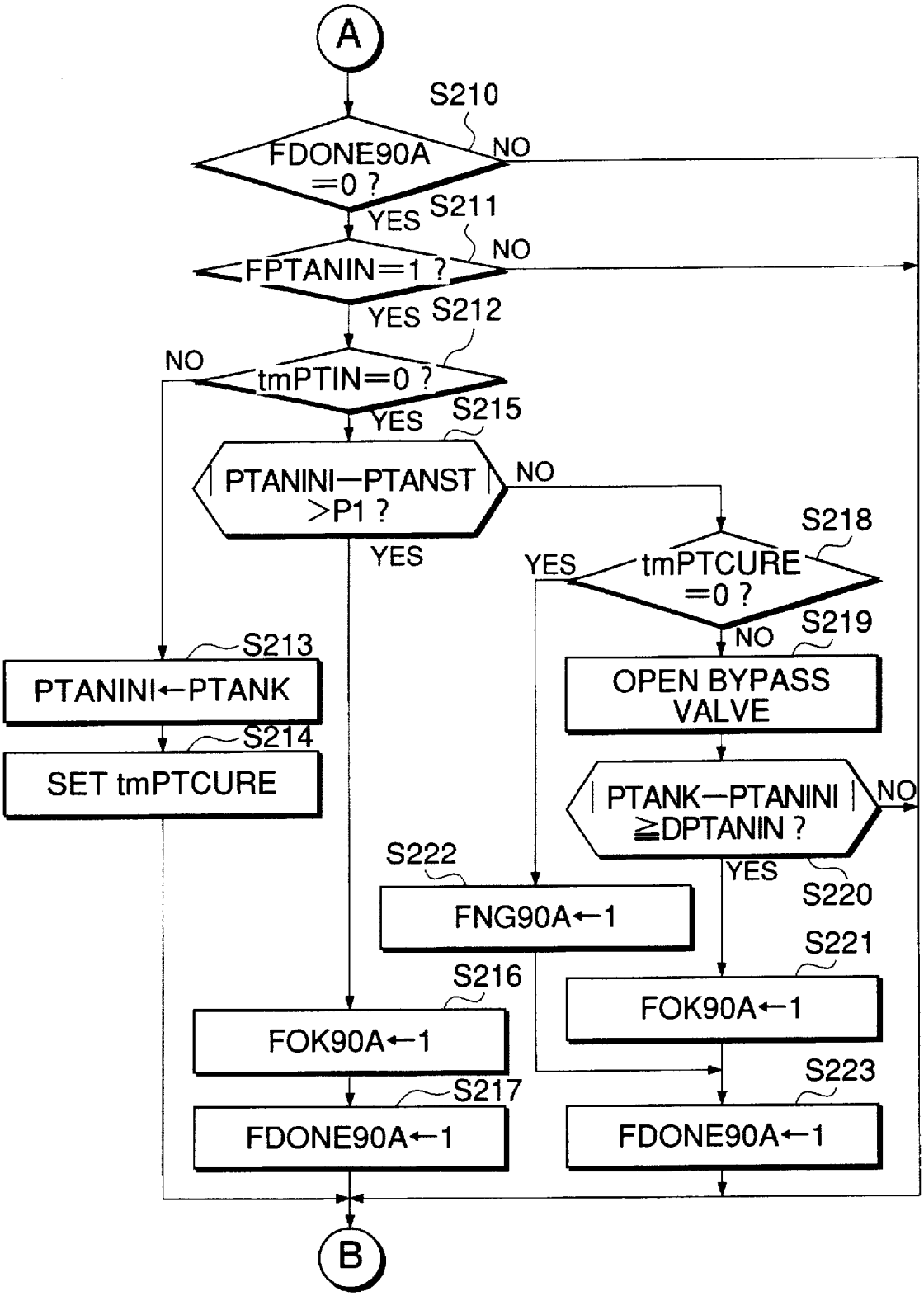
FIG. 3 is a continued part of the flowchart of FIG. 2.

FIGS. 2 and 3 show a program for carrying out tank monitoring, i.e. a process for determining whether or not there is leakage from the tank system at cold starting of the engine 1. This program is executed by the CPU of the ECU 5 at predetermined time intervals (e.g. 80 msec).

First, at a step S201, it is determined whether or not the engine 1 is in starting mode. The starting mode is determined depending on the engine rotational speed NE calculated based on a time lapse from the time the immediately preceding TDC signal was generated to the time the present TDC signal has been generated. If the engine rotational speed NE is below a predetermined value (e.g. 400 rpm), it is determined that the engine 1 is in the starting mode. If it is determined that the engine 1 is in the starting mode, the program proceeds to a step S202, wherein it is determined whether or not a fail-safe operation (F/S) for the TA sensor 14 or the TW sensor 15 has been detected. If the answer is affirmative (YES), a tank monitoring permission flag FPTANIN which, when set to "1", indicates that detection of leakage from the fuel tank 9 is permitted, is set to "0" at a step S209, followed by terminating the present routine.

On the other hand, if it is determined at the step S202 that the fail-safe operation has not been detected, it is determined at a step S203 whether or not the intake air temperature TA falls within a predetermined range between upper and lower limit values TWASTH and TWASTL. If the TA value falls within the predetermined range, it is determined at a step S204 whether or not the engine coolant temperature TW falls within the predetermined range between the upper and lower limit values TWASTH and TWASTL. If the TW value falls within the predetermined range, it is determined at a step S205 whether or not the absolute value of the difference between the intake air temperature TA and the engine coolant temperature TW is smaller than a reference value DTWAST. If the intake air temperature TA and the engine coolant temperature TW both fall within the predetermined range between the upper and lower limit values TWASTH and TWASTL and at the same time the absolute value of the difference between the TA value and the TW value is smaller than the reference value DTWAST, it is determined that the engine has been started in a cold condition, and the program proceeds to a step S206. On the other hand, if any of the answers to the questions of the steps S203 to S205 is negative (NO), the program proceeds to the step S209.

At the step S206, the tank monitoring permission flag FPTANIN is set to "1", and the present value of the tank internal pressure PTANK is set as a starting mode initial pressure PTANST within the fuel tank 9 at a step S207. Then, a tank internal pressure monitoring timer tmPTIN is set to a predetermined time period TPTIN and started at a step S208, followed by terminating the present routine.

If it is determined at the step S201 that the engine is not in the starting mode, the program proceeds to a step S210 in FIG. 3, wherein it is determined whether or not a tank monitoring completion flag FDONE90A which, when set to "1", indicates that the tank monitoring has been completed, is set to "0". If the tank monitoring completion flag FDONE90A is set to "1", the program is immediately terminated, whereas if it is set to "0", the program proceeds to a step S211.

At the step S211, it is determined whether or not the tank monitoring permission flag FPTANIN is set to "1". If the tank monitoring permission flag FPTANIN is set to "0", the program is immediately terminated, whereas if it is set to "1", the program proceeds to a step S212.

At the step S212, it is determined whether or not the count value of the timer tmPTIN has reached "0". If it has not reached "0", the present value of the tank internal pressure PTANK is set as a before-valve opening pressure PTANINI within the fuel tank 9 assumed just before opening of the bypass valve 24 at a step S213, and a bypass valve-opening control timer tmPTCURE is set to a predetermined time period TPTCURE and started at a step S214, followed by terminating the present routine. The predetermined time period TPTCURE is set, e.g. to a sufficiently long-time period within which the tank internal pressure PTANK becomes equal to atmospheric pressure.

On the other hand, if it is determined at the step S212 that the count value of the timer tmPTIN has reached "0", the program proceeds to a step S215, wherein the absolute value AB1 of the difference between the before-valve opening pressure PTANINI set at the step S213 and the initial pressure PTANST set at the step S207 is larger than a reference value P1. If the absolute value AB1 is larger than the reference value P1, a tank system normality-determining flag FOK90A which, when set to "1", indicates that the tank system is normal (has no leakage), is set to "1" at a step S216, and the tank monitoring completion flag FDONE90A is set to "1" at a step S217, followed by terminating the present routine. By virtue of execution of the step S215, whether the tank system is normal or not can be determined at an early stage after the start of the engine. This makes it unnecessary to carry out determination of abnormality of the tank system by opening the bypass valve 24 at a step S218 et seq.

On the other hand, if it is determined at the step S 215 that the absolute value AB1 is equal to or smaller than the reference value P1, the program proceeds to the step S218, wherein it is determined whether or not the count value of the timer tmPTCURE is equal to "0". If the count value of the timer tmPTCURE is equal to "0", a tank system abnormality-determining flag FNG90A which, when set to "1", indicates that the tank system is abnormal (has leakage), is set to "1" at a step S222, and then the step S223 is executed, followed by terminating the present routine. On the other hand, if the count value is not equal to "0", the program proceeds to a step S219.

At the step S219, the bypass valve 24 is opened, and it is determined at a step S220 whether or not the absolute value AB2 of the difference between the present value of the tank internal pressure PTANK and the before-valve opening pressure PTANINI set at the step S213 is equal to or larger than a reference value DPTANIN (e.g. 2 mmHg). If the absolute value AB2 is equal to or larger than the reference value DPTANIN, the tank system normality-determining flag FOK90A is set to "1" at a step S221, and then the tank monitoring completion flag FDONE90A is set to "1", followed by terminating the present routine.

On the other hand, if it is determined at the step S220 that the absolute value AB2 is smaller than the reference value DPTANIN, the program is immediately terminated.

Thus, when the bypass valve 24 is opened after cold starting of the engine 1, if the absolute value AB2 becomes equal to or larger than the reference value DPTANIN within the predetermined time period TPTCURE, it is determined that the tank system is normal, whereas if the absolute value AB2 is smaller than the reference value DPTANIN within the predetermined time period TPTCURE, it is determined that the tank system is abnormal.

According to the tank monitoring of the present embodiment described above, whether there is leakage from the tank system is determined by utilizing the fact that when the engine 1 is started in a cold condition, if the bypass valve 24 is opened, the tank internal pressure PTANK becomes equal to the atmospheric pressure. As a result, accurate determination as to abnormality of the tank system can be achieved without being affected by a zero-point shift in the output from the pressure sensor 11 caused by deterioration, variations, etc. of the pressure sensor 11. Therefore, an excessive margin need not be provided for the threshold value for the abnormality determination, which enables and facilitates accurate determination of the presence/absence of abnormality in the tank system. Further, since the tank monitoring is carried out immediately after cold starting of the engine 1 when the tank monitoring is not affected by generation of evaporative fuel in the fuel tank, the abnormality determination can be carried out irrespective of whether the before-valve opening pressure PTANINI assumes a negative value or a positive value with respect to the atmospheric pressure PA.

Further, the abnormality determination of the tank system is performed at an early stage after the start of the engine, which can dispense with further execution of the tank system abnormality determination at a later stage, i.e. during the operation of the engine, to thereby enable simplifying the abnormality determination process. Further, the abnormality determination method of the present invention does not require changing the hardware construction of the system, which can avoid complication of the structure of the system.

Still further, according to the present embodiment, if the change in the tank internal pressure PTANK over the predetermined time period TPTIN after the cold starting of the engine is larger than the reference value P1, it is determined that the tank system is normal, thus obtaining a normality determination of the tank system at an early stage and hence enabling omission of execution of later processing (steps S218 to S223) by opening the bypass valve 24 as described above. As a result, the subsequent processing can be simplified.

If the engine is started not in a cold condition, the presence/absence of abnormality in the tank system is determined by an abnormality determination process described hereinafter.

Figure 4A:
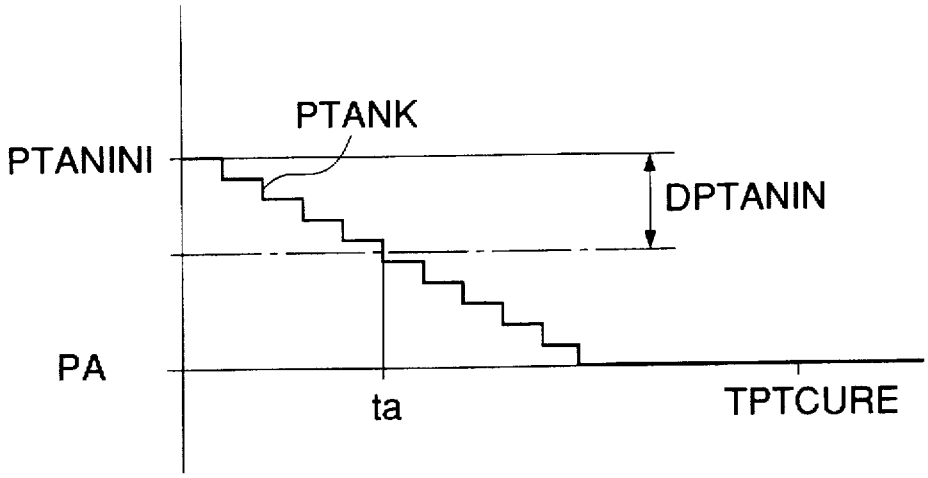
FIG. 4A is a graph useful in explaining a change in tank internal pressure PTANK after cold starting of the engine, when a before-valve opening pressure PTANINI assumes a positive value, according to the tank monitoring.
Figure 4B:
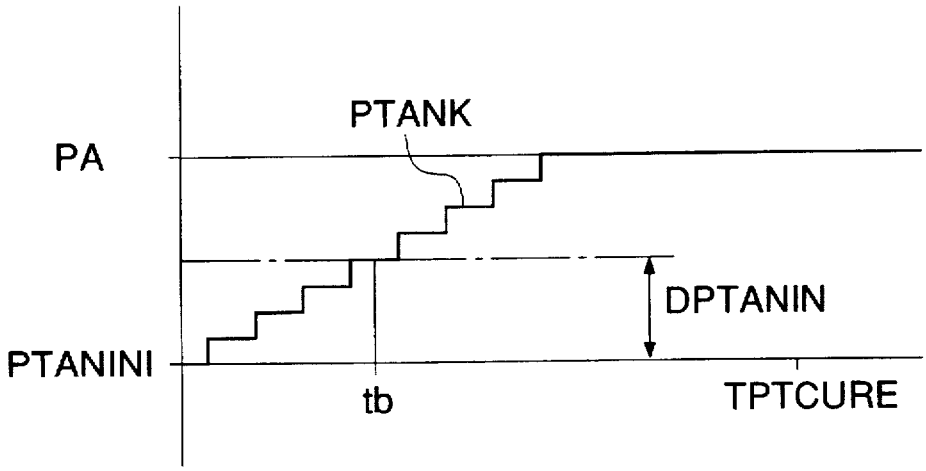
FIG. 4B is a graph useful in explaining a change in the tank internal pressure PTANK after the cold starting of the engine, when the the before-valve opening pressure PTANINI assumes a negative value.

FIGS. 4A and 4B show changes in the tank internal pressure PTANK occurring after cold starting of the engine according to the above described tank monitoring. In the figures, the time period elapsed after opening of the bypass valve is plotted on the abscissa, and the output from the pressure sensor 11 on the ordinate. FIG. 4A shows a case where the before-valve opening pressure PTANINI assumes a positive value higher than the atmospheric pressure, while FIG. 4B shows a case where the before-valve opening pressure PTANINI assumes a negative value lower than the atmospheric pressure.

According to the tank monitoring, after the bypass valve 24 is opened immediately after cold starting of the engine 1, the tank internal pressure PTANK approaches to the atmospheric pressure irrespective of whether the before-valve opening pressure PTANINI assumes a negative value or a positive value.

On this occasion, if there is no leakage from the tank system and at the same time the absolute value of the difference between the before-valve opening pressure PTANINI and the atmospheric pressure is larger than the reference value DPTANIN, the tank internal pressure PTANK changes by the reference value DPTANIN or more. On the other hand, if there is leakage from the tank system, the before-valve opening pressure PTANINI should always be equal to the atmospheric pressure, and accordingly the tank internal pressure PTANK cannot change by the reference value DPTANIN or more. Therefore, if the tank internal pressure PTANK changes by the reference value DPTANIN or more before the predetermined time period TPTCURE suitably set as mentioned above elapses, it is determined that the tank system does not suffer from leakage and hence it is normal. For example, in FIG. 4A, the tank internal pressure PTANK has changed by the reference value DPTANIN or more at or after a time point ta, and in FIG. 4B, the tank internal pressure PTANK has changed by the reference value DPTANIN or more at or after a time point tb. Therefore, in both the cases of FIGS. 4A and 4B, it is determined that the tank system does not suffer from leakage and hence it is normal.

Figure 5:
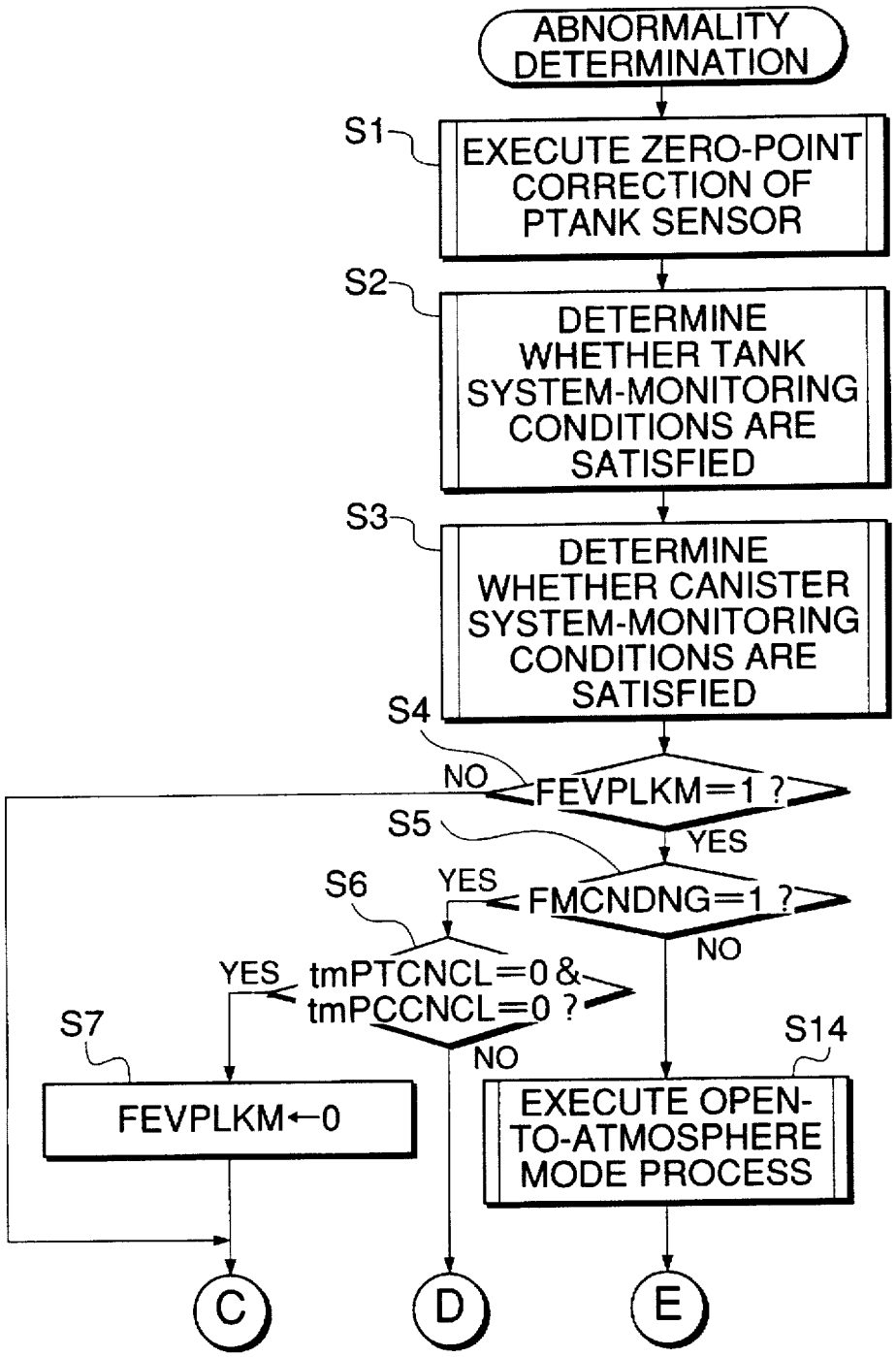
FIG. 5 is a flowchart showing a program for carrying out overall abnormality determination of an evaporative emission control system appearing in FIG. 1.

FIGS. 5 and 6 show a program for carrying out overall abnormality determination of the evaporative emission control system 31, i.e. for determining whether or not the evaporative emission control system 31, i.e. the canister system and the tank system, suffers from leakage after the start of the engine 1. This program is executed by the CPU of the ECU 5 at predetermined time intervals (e.g. 80 msec).

First, at a step S1, zero-point correction of the pressure sensor (PTANK sensor) 11 is carried out. More specifically, when the intake air temperature TA and the engine coolant temperature TW both detected at the start of the engine are within the respective predetermined ranges and at the same time the difference between the two values TA and TW is small (at cold starting of the engine), the bypass valve 24 is opened from its closed position while the vent shut valve 26 is open and the purge control valve 30 is closed. Then, the zero-point correction of the output value from the sensor 11 is carried out based on a change in the output from the pressure sensor 11 which is caused by the above opening of the bypass valve 24 from its closed position.

At a step S2, it is determined whether or not tank system monitoring conditions (preconditions for permitting abnormality determination as to the tank system) are satisfied. The tank system monitoring conditions are satisfied, for example, when purging is being carried out with the purge control valve 30 opened, the engine is in a predetermined steady operating condition, the vehicle is cruising with a small change in the vehicle speed VP, and at the same time the air-fuel ratio correction coefficient KO2 is larger than a predetermined value and hence the influence of purged evaporative fuel is small. If the tank system monitoring conditions are satisfied, a tank system-monitoring permission flag FMCND90A and a monitoring permission flag FEVPLKM are both set to "1", whereas if the tank system monitoring conditions are not satisfied, the tank system-monitoring permission flag FMCND90A is set to "0". If the tank monitoring completion flag FDONE90A is set to "1" by executing the process of FIGS. 2 and 3, the tank monitoring permission flag FMCND90A is set to "0". The monitoring permission flag FEVPLKM is set to "1" if canister system monitoring conditions, referred to hereinafter, are satisfied. While the canister system is being monitored, the tank system monitoring conditions are set unsatisfied.

At a step S3, it is determined whether or not the canister system monitoring conditions (preconditions for permitting abnormality determination as to the canister system) are satisfied. The canister system monitoring conditions are satisfied, similarly to the tank system monitoring conditions, when purging is being carried out, the engine is in a predetermined steady operating condition, the vehicle is cruising with a small change in the vehicle speed VP, and at the same time the air-fuel ratio correction coefficient KO2 is larger than a predetermined value and hence the influence of purged evaporative fuel is small. If the canister system monitoring conditions are satisfied, a canister system-monitoring permission flag FMCND90B and the monitoring permission flag FEVPLKM are both set to "1", whereas if the canister system monitoring conditions are not satisfied, the canister system-monitoring permission flag FMCND90B is set to "0". The monitoring permission flag FEVPLKM is set to "1" if the tank system monitoring conditions are satisfied. While the tank system is being monitored, the canister system monitoring conditions are set unsatisfied.

At a step S4, it is determined whether or not the monitoring permission flag FEVPLKM is equal to "1". If FEVPLKM=0 holds, which means that the tank system monitoring conditions and the canister system monitoring conditions are both unsatisfied, the program proceeds to a step S9.

At the step S9 in FIG. 6, it is determined whether or not a calculation of a zero-point shift of the output from the pressure sensor 11 is being executed. During execution of the calculation of the zero-point shift of the output from the pressure sensor 11, the bypass valve 24 is opened and the purge control valve 30 is closed (while the vent shut valve 26 is open), and therefore the program skips a step S10 over to a step S11. On the other hand, if the calculation is not being carried out, the program proceeds to the step S10, wherein a normal control mode is set, that is, the bypass valve 24 is closed, the vent shut valve 26 is opened, and the purge control valve 30 is duty-controlled, to thereby control an amount of evaporative fuel to be supplied to the intake system 2 of the engine 1.

At the step S11, an open-to-atmosphere timer (down-counting timer) tmPATM for controlling the maximum time period of an open-to-atmosphere mode process, referred to hereinafter, is set to a predetermined time period TPATM (e.g. 15 sec) and started.

At a step S12, the following various flags to be used in the present processing are reset. That is, an open-to-atmosphere flag FPATM which, when set to "1", indicates that the open-to-atmosphere mode has been completed, is set to "0". A tank system negative pressurization mode flag FPTDEC which, when set to "1", indicates that a tank system negative pressurization mode process (at a step S22) is to be carried out, is set to "0". A tank system leakage-checking mode flag FTKLKCHK which, when set to "1", indicates that a tank system leakage-checking mode process (at a step S23) is to be carried out, is set to "0". A feedback negative pressurization permission flag FPTFB which, when set to "1", indicates that feedback negative pressurization in the tank system negative pressurization mode is permitted, is set to "0". A pressure-recovering mode flag FPCNCL which, when set to "1", indicates that a pressure-recovering mode process (at a step S27) is to be carried out, is set to "0". A correction-checking mode flag FPTREV which, when set to "1", indicates that a correction-checking mode process (at a step S28) is to be carried out, is set to "0". A canister system negative pressurization mode flag FPCDEC which, when set to "1", indicates that a canister system negative pressurization mode process (at a step S16) is to be carried out, is set to "0". An internal pressure stabilization mode flag FPCBALA which, when set to "1", indicates that an internal pressure stabilization mode process (at a step S17) is to be carried out, is set to "0". A canister system leakage-checking mode flag FPCLK which, when set to "1", indicates that a canister system leakage-checking mode process (at a step S18) is to be carried out, is set to "0". Further, a monitoring-stopping flag FMCNDNG which, when set to "1", indicates that the tank monitoring or the canister monitoring is to be stopped during execution of tank monitoring or canister monitoring (i.e. the pressure-recovering mode) is set to "0".

At the following step S13, the tank internal pressure PTANK detected in the present loop is stored as initial tank internal pressure PATM0, followed by terminating the present routine.

If the tank system monitoring conditions or the canister system monitoring conditions are satisfied, and hence the monitoring permission flag FEVPLKM is made equal to "1" at the step S4, the program proceeds to a step S5, wherein it is determined whether or not the monitoring-stopping flag FMCNDNG is equal to "1". If FMCNDNG=1 holds, it is determined at a step S6 whether or not the count values of a tank system pressure-recovering timer (down-counting timer) tmPTCNCL and a canister system pressure-recovering timer (down-counting timer) tmPCCNCL, which are set, respectively, at steps S26 and S20, referred to hereinafter, are both equal to "0". If tmPTCNCL>0 or tmPCCNCL>0 holds, the program proceeds to the step S27. On the other hand, if tmPTCNCCL=0 and tmPCCNCL=0 both hold, the monitoring permission flag FEVPLKM is set to "0" at a step S7, followed by the program proceeding to the step 9.

If FMCNDNG=0 holds at the step S5, which means that the monitoring conditions for the tank system or the canister system are satisfied, the open-to-atmosphere mode process is executed at a step S14.

The open-to-atmosphere mode process is executed when either the tank system monitoring permission flag FMCND90A or the canister system monitoring permission flag FMCND90B is set to "1", and carried out by opening the purge control valve 30 and then opening the bypass valve 11 and the vent shut valve 26.

In the open-to-atmosphere mode process, the open-to-atmosphere mode completion flag FPATM, the tank system negative pressurization mode flag FPTDEC, and the canister system negative pressurization mode flag FPCDEC are set to "1" depending on conditions of execution of the open-to-atmosphere mode process.

At the following step S15 in FIG. 6, it is determined whether or not the canister system-monitoring permission flag FMCND90B is equal to "1". If FMCND90B=1 holds, the canister system abnormality determination at the step S16 et seq. is executed.

First, at the step S16, the canister system negative pressurization mode process is executed. More specifically, the bypass valve 24 is kept open, the vent shut valve 26 is closed, and the purge control valve 30 is duty-controlled, to thereby negatively pressurize the evaporative emission control system 31 so as to make the tank internal pressure PTANK equal to a predetermined negative value. At the step S17, the internal pressure-stabilization mode process is executed. More specifically, the vent shut valve 25 is kept closed, and the bypass valve 24 and the purge control valve 30 are both closed, to thereby maintain the negatively pressurized state over a predetermined time period TPCBALA.

Then, the canister system leakage-checking mode process is executed at the step S18. More specifically, the vent shut valve 26 and the purge control valve 30 are kept closed, and the bypass valve 24 is opened. Then, if an amount of decrease (PCBALA–PTANK) obtained by subtracting the tank internal pressure PTANK assumed after the lapse of a predetermined time period TPCLK from a tank internal pressure value PCBALA assumed at the start of the leakage-checking mode is smaller than a predetermined value DPCANI, it is determined that the canister system is abnormal. On the other hand, if the amount of decrease exceeds the predetermined value DPCANI before the lapse of the predetermined time period TPCLK, it is determined that the canister system is normal, and then the canister system leakage-checking mode process is terminated. This determination is based on the fact that if the canister system is normal, the pressure within the canister system assumed at the end of the internal pressure stabilization mode falls, e.g. to approximately –40 mmHg, and accordingly the tank internal pressure PTANK assumed after opening of the bypass valve 24 falls by the predetermined value DPCANI or more due to the fall in pressure within the canister system.

At the following step S20, the canister system pressure-recovering timer tmPCCNCL, referred to at the step S6, is set to a predetermined time period TPCCNCL (e.g. 0.1 sec) and started, followed by the program proceeding to the step S27.

If FMCND90B=0 holds at the step S15, it is determined at a step S21 whether or not the tank system-monitoring permission flag FMCND90A is equal to "1". If FMCND90A=0 holds, the program jumps to the step S27. On the other hand, if FMCND90A=1 holds, the tank system abnormality determination is carried out by executing the step S22 et seq.

First, at the step S22, the tank system negative pressurization mode process is executed. More specifically, similarly to the canister system negative pressurization mode process, the bypass valve 24 is kept open, the vent shut valve 26 is closed, and the purge control valve 30 is duty-controlled, to thereby negatively pressurize the evaporative emission control system 31 so as to make the tank internal pressure PTANK equal to a predetermined negative value.

Then, the tank system leakage-checking mode process is executed at the step S23. More specifically, the vent shut valve 26 is kept closed, and the bypass valve 24 and the purge control valve 30 are closed, to thereby detect an amount of increase PTVARIB in the PTANK value over a predetermined time period, etc.

At the following step S25, it is determined whether or not the pressure-recovering mode flag FPCNCL or the correction-checking mode flag FPTREV is equal to "1". FPCNCL=FPTREV=0 holds until the tank system leakage-checking mode is completed, and therefore the tank system pressure-recovering timer tmPTCNCL is set to a predetermined time period TPTCNCL (e.g. 0.1 sec) and started at the step S26, followed by the program proceeding to the step S27. On the other hand, if the tank system leakage-checking mode has been completed, the pressure-recovering mode flag FPCNCL is set to "1", and then the program skips from the step S25 to the step S27.

At the step S27, the pressure-recovering mode process is executed. More specifically, the bypass valve 24 is kept open, the purge control valve 30 is kept closed, and the vent shut valve 26 is opened, to thereby introduce air into the canister system and the tank system. Then, the tank system abnormality determination is carried out based on a change in the tank internal pressure PTANK. If the tank monitoring of FIGS. 2 and 3 has been carried out to determine that the tank system is normal, this abnormality determination in the pressure-recovering mode process is not carried out. If abnormality or normality of the tank system is finally determined, the program is immediately terminated without executing the correction-checking mode process. On the other hand, if no abnormality or normality of the same is finally determined, the pressure-recovering mode flag FPCNCL is set to "0", and the correction-checking mode flag FPTREV is set to "1", followed by the program proceeding to the correction-checking mode process.

At the step S28, the correction-checking mode process is executed. More specifically, the vent shut valve 26 is kept open, the purge control valve 30 is kept closed, and the bypass valve 24 is closed, to thereby detect a rate of variation PVARIC in the PTANK value over a predetermined time period. Then, a comparison is made between the rate of increase PVARIB detected at the step S23 and the rate of variation PVARIC detected at the step S28, to thereby execute the tank system abnormality determination.

After the execution of the step S28, the present program is terminated.

According to the present embodiment described above, the process of FIGS. 5 and 6 is executed at predetermined time intervals after an ignition switch of the engine is turned on. Once the above described series of determinations (from the step S14 to the step S28) have been executed to finally determine abnormality or normality of the emission control system, however, the abnormality determination is no more executed. Thereafter, when the engine is stopped and then started again, the determination of FIGS. 5 and 6 is executed once. That is, the determination is executed once over one operation period of the engine from the time the ignition switch is turned on to start the engine to the time the engine is stopped.

What is claimed is:

1. In an evaporative fuel-processing system for an internal combustion engine having a fuel tank, and an intake system, including a canister for adsorbing evaporative fuel generated in said fuel tank, a charging passage extending between said canister and said fuel tank, a pressure-regulating valve arranged across said charging passage, for regulating pressure within said fuel tank to a predetermined value, a bypass passage bypassing said pressure-regulating valve, a bypass valve arranged across said bypass passage, for opening and closing said bypass passage, a purging passage extending between said canister and said intake system, an open-to-atmosphere passage for relieving an interior of said canister to atmosphere, a tank system formed by a part of said charging passage on one side of said bypass valve closer to said fuel tank, inclusive of said fuel tank, and a pressure sensor for detecting pressure within said tank system, the improvement comprising:

valve-opening means for opening said bypass valve at cold starting of said engine;

comparing means for comparing a difference between an output value from said pressure sensor obtained before opening of said bypass valve and an output value from said pressure sensor obtained after said opening of said bypass valve with a predetermined value; and leakage-checking means for checking presence of leakage from said tank system, based on a result of the comparison by said comparing means.

2. An evaporative fuel-processing system as claimed in claim 1, wherein said leakage-checking means includes normality-determining means for determining that said tank system is normal when said difference is equal to or larger than said predetermined value.

3. An evaporative fuel-processing system as claimed in claim 1, wherein said leakage-checking means includes abnormality determining means for determining that said tank system is abnormal when said difference is smaller than said predetermined value.

4. An evaporative fuel-processing system as claimed in claim 2, including temperature-detecting means for detecting temperature of intake air supplied to said engine and temperature of coolant of said engine, and cold starting-determining means for determining that said engine has been started in a cold condition if said engine has been started when said temperature of said intake air and said temperature of said coolant detected by said temperature-detecting means both fall within a predetermined range and at the same time a difference between said temperature of said intake air and said temperature of said coolant is below a predetermined value.

5. An evaporative fuel-processing system as claimed in claim 3, including temperature-detecting means for detecting temperature of intake air supplied to said engine and temperature of coolant of said engine, and cold starting-determining means for determining that said engine has been started in a cold condition if said engine has been started when said temperature of said intake air and said temperature of said coolant detected by said temperature-detecting means both fall within a predetermined range and at the same time a difference between said temperature of said intake air and said temperature of said coolant is below a predetermined value.

6. An evaporative fuel-processing system as claimed in claim 2, including enabling means operable when an amount of change in an output value from said pressure sensor over a predetermined time period from said cold starting of said engine is equal to or smaller than a predetermined value, for enabling said valve-opening means to open said bypass valve and said normality-determining means to execute the determination as to normality of said tank system.

7. An evaporative fuel-processing system as claimed in claim 3, including enabling means operable when an amount of change in an output value from said pressure sensor over a predetermined time period from said cold starting of said engine is equal to or smaller than a predetermined value, for enabling said valve-opening means to open said bypass valve and said abnormality-determining means to execute the determination as to abnormality of said tank system.

8. An evaporative fuel-processing system as claimed in claim 6, including second normality-determining means for determining that said tank system is normal when said amount of change in said output value from said pressure sensor over said predetermined time period from said cold starting of said engine is larger than said predetermined value.

9. An evaporative fuel-processing system as claimed in claim 7, including normality-determining means for determining that said tank system is normal when said amount of change in said output value from said pressure sensor over said predetermined time period from said cold starting of said engine is larger than said predetermined value.

10. An evaporative fuel-processing system as claimed in claim 1, wherein said valve-opening means opens said bypass valve over a predetermined time period within which an output value from said pressure sensor becomes equal to atmospheric pressure after said bypass valve is opened by said valve-opening means.

* * * * *